US006852935B2

(12) United States Patent
Higgins et al.

(10) Patent No.: US 6,852,935 B2
(45) Date of Patent: Feb. 8, 2005

(54) TILT SWITCH

(75) Inventors: Sidney A. Higgins, Maple Grove, MN (US); Timothy M. Muotka, Waseca, MN (US)

(73) Assignee: Itron, Inc., Spokane, WA (US)

( * ) Notice: Subject to any disclaimer, the term of this patent is extended or adjusted under 35 U.S.C. 154(b) by 121 days.

(21) Appl. No.: 10/283,646

(22) Filed: Oct. 30, 2002

(65) Prior Publication Data

US 2004/0084290 A1 May 6, 2004

(51) Int. Cl.[7] ..... H01H 35/14

(52) U.S. Cl. ..... 200/61.52; 200/61.45 R

(58) Field of Search ..... 200/61.45 R–61.52; 73/493, 504.12, 504.13, 514.16, 514.35

(56) References Cited

U.S. PATENT DOCUMENTS

| | | | | |
|---|---|---|---|---|
| 3,599,745 A | | 8/1971 | Hughes | 180/104 |
| 3,601,729 A | | 8/1971 | Hierta | 335/205 |
| 3,729,602 A | | 4/1973 | Myers | 200/61.52 |
| 3,763,484 A | | 10/1973 | Byers | 340/262 |
| 3,812,308 A | | 5/1974 | Bell et al. | 200/61.45 R |
| 3,816,680 A | | 6/1974 | Suzuki et al. | 200/61.51 |
| 3,818,160 A | | 6/1974 | Hitchcock | 200/61.45 R |
| 3,831,163 A | | 8/1974 | Byers | 340/262 |
| 3,927,286 A | | 12/1975 | Föhl | 200/61.45 R |
| 4,001,185 A | | 1/1977 | Mitsui et al. | 200/61.45 R |
| 4,135,067 A | | 1/1979 | Bitko | 200/61.52 |
| 4,467,154 A | | 8/1984 | Hill | 200/61.45 R |
| 4,542,337 A | | 9/1985 | Rausch | 324/110 |
| 4,618,746 A | | 10/1986 | Schwob et al. | 200/61.45 R |
| 4,628,160 A | | 12/1986 | Canevari | 200/61.45 R |
| 4,737,759 A | | 4/1988 | Stropkay et al. | 340/52 H |
| 5,006,676 A | | 4/1991 | Bogut et al. | 200/61.52 |
| 5,107,203 A | | 4/1992 | Timko | 324/110 |
| RE34,175 E | | 2/1993 | Grimes et al. | 200/84 R |
| 5,209,343 A | | 5/1993 | Romano et al. | 200/61.52 |
| 5,285,033 A | * | 2/1994 | Ipcinski | 200/61.52 |
| 5,332,876 A | | 7/1994 | Romano et al. | 200/61.52 |
| 5,473,322 A | | 12/1995 | Carney | 340/870.02 |
| 5,533,520 A | * | 7/1996 | Inguaggiato | 600/595 |
| 5,610,338 A | | 3/1997 | Kato et al. | 73/652 |
| 5,808,254 A | * | 9/1998 | Wu | 200/61.45 R |
| 5,877,686 A | * | 3/1999 | Ibey et al. | 340/571 |
| 5,900,602 A | | 5/1999 | Bitko | 200/61.52 |
| 6,118,269 A | | 9/2000 | Davis | 324/110 |

(List continued on next page.)

FOREIGN PATENT DOCUMENTS

| | | | |
|---|---|---|---|
| CN | 1074413 A | 7/1993 | B60K/28/14 |
| CN | 1240899 A | 1/2000 | F21V/25/04 |
| EP | 0167429 | 5/1985 | H01H/35/14 |
| JP | 05026308 | 1/1993 | H01H/35/02 |
| JP | 05272159 | 10/1993 | H01H/35/02 |
| JP | 20000165220 | 4/2000 | G08B/13/00 |
| WO | WO89/01233 | 2/1989 | H01H/35/02 |
| WO | WO01/09571 | 2/2001 | G01G/19/56 |

OTHER PUBLICATIONS

Dana Corporation, *American Electronic Components—Ball Switches and Specialty Switches*, 1999.

*Primary Examiner*—Michael A. Friedhofer
(74) *Attorney, Agent, or Firm*—Patterson, Thuente, Skaar & Christensen, P.A.

(57) ABSTRACT

A low cost, tilt switch of simple construction facilitates tamper detection or provides notice of equipment tipping for safety applications. In one example embodiment, a tilt sensor includes an electrically insulative housing, a conductive ball, and two opposing electrical contacts. The switch further includes an arrangement for aligning the two opposing electrical contacts when the tilt sensor housing is formed. The sensor is mountable in a device being monitored for tilt or excessive movement. In one example application, the tilt switch or sensor effects an electrical connection that signals meter tampering when a meter is moved or inverted.

25 Claims, 4 Drawing Sheets

SECTION C-C

U.S. PATENT DOCUMENTS 6,180,873 B1 1/2001 Bitko ..... 174/9 F
6,198,059 B1 3/2001 Jou ..... 200/61.52
6,232,886 B1 5/2001 Morand ..... 340/870.02
6,339,199 B1 1/2002 Chou et al. ..... 200/61.52
6,348,665 B1 2/2002 Ohashi et al. ..... 200/61.52
6,448,516 B1 * 9/2002 Chiang ..... 200/61.45 R
6,455,790 B1 * 9/2002 Ogden ..... 200/61.46

* cited by examiner

SECTION B-B 140
144
146
147
142

170
156
130A
140
150
160
.060

140
144
124a
122b
120b
120a
156
130a
SECTION A-A
110
160
B
142
152
B
130
122a
124b
120
154
150

122a
147
146
142
124a
140
130
120a

TILT SWITCH

FIELD OF THE INVENTION

The present invention relates to electrical switches that are responsive to being oriented at an angle to close an electrical circuit. In addition, the present invention relates to manufacturing electrical switches that are environmentally friendly.

BACKGROUND OF THE INVENTION

Electrical tilt switches can operate to open or close electrical circuits as a function of the angle of inclination of the switch. Such switches normally include a free moving electrically conductive element that contacts at least two terminals when the conductive element moves to an operating position by gravity. A well-known form of the electrical tilt switch is the mercury switch. In a typical mercury switch, a glob of mercury moves freely within a sealed housing. As the housing is inclined, gravity pulls the glob of mercury to one end of the housing where it completes an electrical circuit. Mercury tilt switches are fairly easy to manufacture, however, due to environmental concerns, it is becoming increasingly difficult to manufacture any product that includes mercury because of its toxicity and disposal difficulty.

A common substitute for mercury in a tilt switch is free moving conductive element, such as a single metal ball. Tilt switches utilizing metal balls in place of globs of mercury are exemplified in U.S. Pat. No. 4,628,160 to Canevari and U.S. Pat. No. 3,763,484 to Byers. The use of a metal ball to complete an electric circuit is a simple and inexpensive way to create a tilt switch. Tilt switches have been used in connection with various applications, including electrical appliances to disconnect the power to the appliance where the appliance is accidentally tipped over. Tilt switches have also been used in connection with watt-hour meters to preserve the life of a battery in the unit during shipping, as exemplified in U.S. Pat. No. 5,107,203 to Timko, by disconnecting the battery when the meter is in the vertical (storage) position. A movable member (e.g., a metallic ball) within a tilt switch moves off of the internal contacts connecting the battery and the electronic circuitry when the meter is moved from the horizontal orientation.

The use of induction type watt-hour meters installed in meter sockets at customers' sites has led to wide-spread tampering of watt-hour meters in an effort to reduce the indicated consumption and thereby defraud the utility company through indication of less-than-actual power consumption. A large share of the meter tampering is done by residential and commercial customers with single-phase induction watt-hour meters. Of the more than twenty-five commonly detected methods of meter tampering, more than two-thirds of these require either removal of the meter from its socket or removal of the cover glass. One well-known method of meter tampering involves removal of the meter from its socket and reinstallation of the meter in an upside down position. Since the terminals are reversed and the meter registers are caused to run in reverse, thereby reducing the total indicated power consumption without interruption of the power supply to the user.

Although U.S. Pat. No. 4,039,943 to Tapscott and U.S. Pat. No. 4,542,337 to Rausch disclose watt-hour meters using a ball switch device to detect meter tampering, both use rather complex electromechanical devices to accomplish their goals. On one hand, Tapscott uses a gravity (ball) switch with an auxiliary magnet scheme to not only cause the meter to operate in the forward direction when installed upside down, but also to cause it to run at a greater rate than indicated by the actual power consumed, thereby penalizing the defrauder. Rausch, on the other hand, discloses an electromechanically complex hall switch having an enclosed race (circular track) with a plurality of spaced outer contacts, where a metallic ball moves around the enclosed race from one outer contact to another. Both devices are parts-intensive and costly to manufacture.

Accordingly, there is a need for a low-cost and highly reliable device that can be adapted to both new and existing meters to readily detect the most common types of meter tampering. A switching device or tilt sensor that addresses the aforementioned problems, as well as other related problems, is therefore desirable.

SUMMARY OF THE INVENTION

Various embodiments of the present invention are directed to addressing various needs in connection with tamper detection and tilt sensing of electrical/electromechanical devices. Some watt-hour meters are equipped with a tilt switch that operates with the switch in a normally closed position. The closed tilt switch is sensitive to external disturbances of the meter, that cause the switch to temporarily open. However, in the present invention the tilt switch operates in the normally open circuit position and detects meter tampering when the switch closes.

One embodiment of the invention is directed to a tilt sensor that includes a first insulative housing member having therein a first electrical conductive member having a first contact portion and a first lead portion extending through and outwardly from the first housing. The tilt sensor also includes a second insulative housing member having therein a second electrically conductive member having a second contact portion and a second lead portion extending through and outwardly from the housing. The second insulative housing is adapted to fit with the first insulative housing to form a tilt sensor housing, the tilt sensor housing having a cavity defined therein by the first and second conductive members. The tilt sensor also includes means, integral with the first and second insulative housing members, for aligning the first and second contact portions to each other and includes an electrically conductive spherical member disposed within the cavity. The first and second contact portions are spaced apart within the housing cavity so as to form a gap, the gap being electrically closed with the conductive spherical member as the spherical members rolls into the gap when the tilt sensor is within a predefined angle of inclination.

In a related embodiment, the tilt sensor also includes an inversion detection feature. The gap between the conductive members is electrically closed with the conductive spherical member (or ball) when the tilt sensor exceeds a predefined angle of inclination and a convex configuration of one of the housing halves protrudes into the housing cavity to push the ball into the gap.

The above summary of the present invention is not intended to describe each illustrated embodiment or every implementation of the present invention. The figures in the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1A:
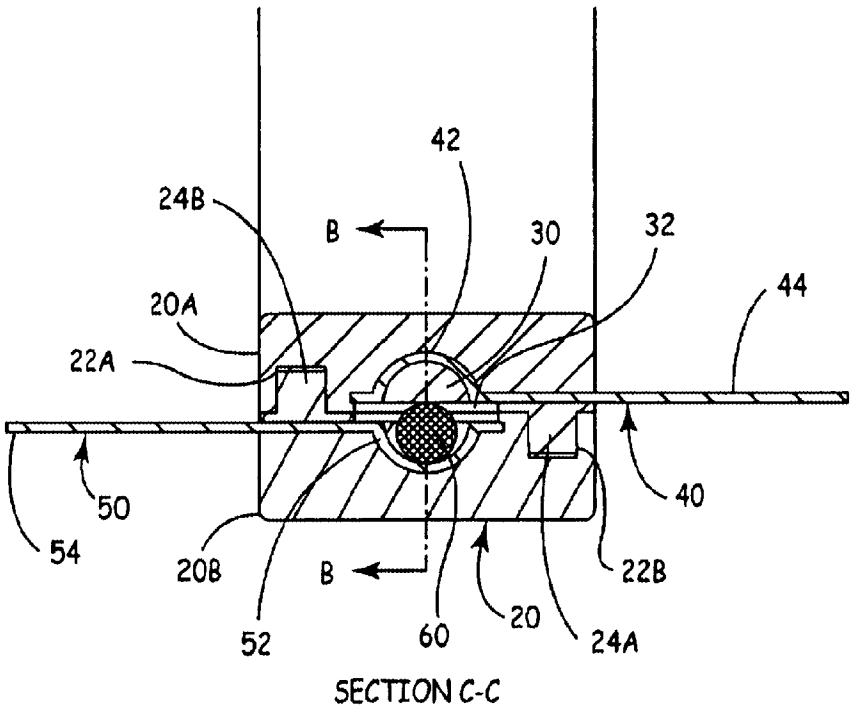
FIG. 1A is a cut away side view of the tilt sensor according to the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF PREFERRED EMBODIMENTS

The present invention is generally directed to a tilt sensor or a switch of a simple construction and having an inversion detection capability. While the present invention is not necessarily limited to such an application, the invention will be better appreciated using a discussion of example embodiments in such a specific context.

In one example embodiment, a tilt sensor includes an electrically insulative housing, a conductive ball, a center conductor and a non-conductive cap. The center conductor is captivated by the non-conductive cap, which is press fit onto the housing after the metallic ball has been placed inside the cavity of the housing. The center conductor can be formed in a configuration to give a desired angle of activation, depending on the application. The sensor is mountable in a device being monitored for tilt or excessive movement. In one example application, a tilt switch or sensor effects an electrical connection that signals meter tampering. During normal meter operation, the tilt switch (or sensor) is in the open circuit position and indicates a tamper when the switch (or sensor) closes. The metallic ball switch indicates a tamper when the circuit within the switch closes (the metallic ball makes contact with the internal contacts).

Referring to FIGS. 1A–1F, a tilt sensor 10 is illustrated that includes an insulative (e.g. polymer) sensor housing 20 that is comprised of two housing members, a top housing member 20A, and a bottom housing member 20B that are configured to fit together to form a single sensor housing 20. Housings 20A and 20B are sonic welded together, in this example, but the means for joining the housing is not so limited. The housing can be adhered together with an adhesive or an outside clip (or band) or can be placed inside of a metal canister for surface mounting on a printed circuit board. Sensor 10 further includes a top housing aperture 22A and a top housing pin 24A that correspond to a bottom housing aperture 22B and a bottom housing pin 24B that fit together to align the housings with each other (center-line to center-line). The fitted housings together also form a cavity 30 within housing 20. Top housing member 20A includes an insert molded, top conductive member 40 that is comprised of a contact portion 42 and a lead portion 44.

Bottom housing member 20B includes insert molded bottom conductive member 50 that includes a contact portion 52 and a lead portion 54 that partially protrudes outside of housing 20. Contact portion 52 includes a concave portion 56 (in the form of a spoon or ladle). Inside of cavity 30 and bounded by conductive members 40 and 50 is a conductive spherical member 60 (e.g. metallic ball) that rolls within cavity 30 of sensor 10 as the sensor is tipped.

Figure 1E:
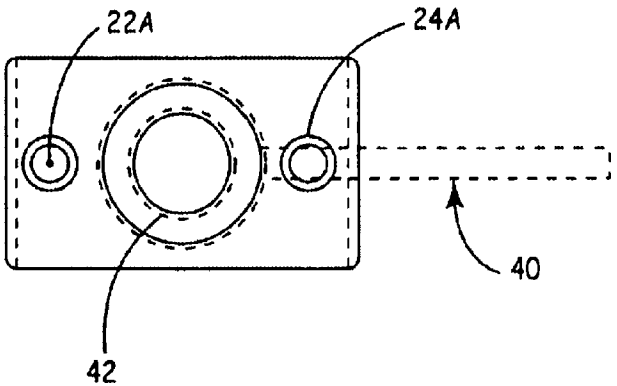
FIG. 1E illustrates a top view of the top half of the tilt sensor housing with a conductive member.
Figure 1F:
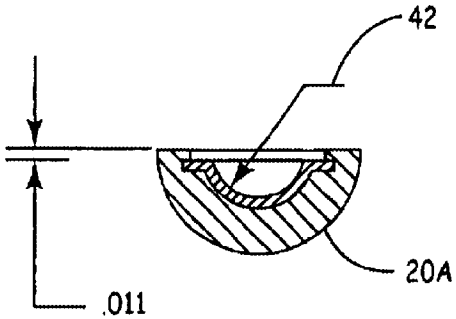
FIG. 1F illustrates a side cut away view of FIG. 1E of the top half of the sensor housing.
Figure 1D:
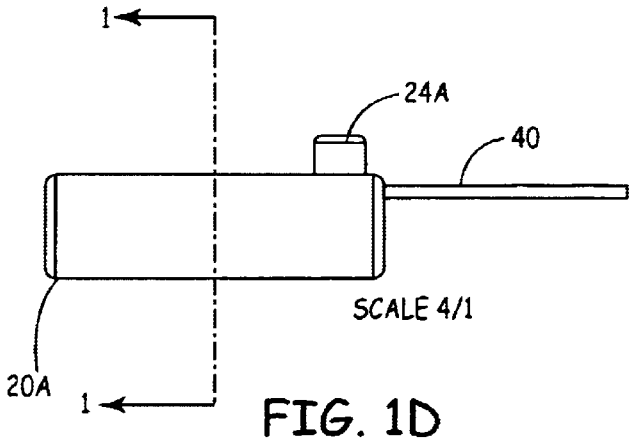
FIG. 1D illustrates a top half of the housing of the tilt sensor of the present invention.
Figure 1B:
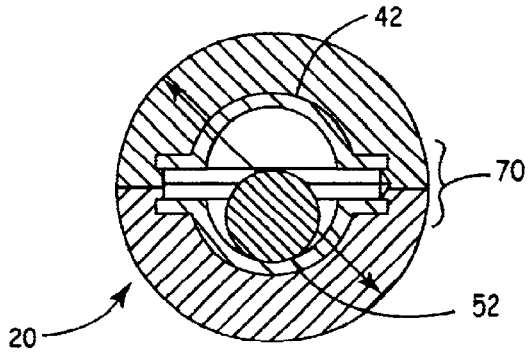
FIG. 1B is a cut away view of tilt sensor of FIG. 1A along section B—B.

FIG. 1B illustrates a cut away side view of sensor 10 along section B—B of FIG. 1A. In this example embodiment, spherical member 60 rests on bottom conductive member 50. A gap 70 is formed between conductive member 40 and conductive member 50 (members 40 and 50 are spaced apart) so as to have a degree of electrical isolation or separation between the two conductive members. When tilt sensor 10 is tipped (or an angle of inclination is imparted), conductive spherical member 60 moves towards gap 70 and eventually spherical member 60 electrically connects conductive member 40 and conductive member 50 to close an electrical circuit. In this example embodiment, closing the electrical circuit constitutes a tamper signal that the sensor 10 (and metering device) has been tipped to such an angle of inclination so as to close the circuit. In one example embodiment, tilt sensor 10 is used in connection with a watt hour meter as a means for signaling and detecting tampering with the meter, such as when the meter is removed from its socket, is tilted or is turned upside down to interfere with its normal operation.

Figure 1C:
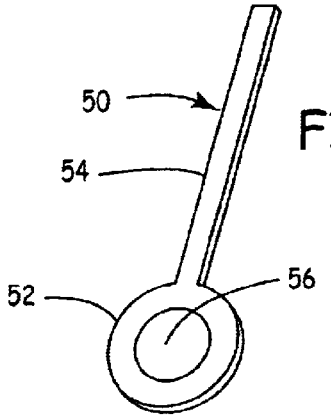
FIG. 1C is one embodiment of conductive member used in the present invention.

FIG. 1C illustrates one example embodiment of a conductive member 50 which is configured in the form of spoon having a concave portion 56 (of contact portion 52) and a lead portion 54 that extends partially outside of housing 20. Concave portion 56 is configured to hold conductive spherical member 60 (or metallic ball) in the steady state/default condition.

FIGS. 1D–1F illustrate separate portions of sensor 10. In particular, FIG. 1D illustrates a side view of the top half of sensor 10 with conductive member 40 embedded in the housing. FIG. 1E illustrates a top view of top housing 20A with pin 24A protruding from the housing and an aperture 22A formed in housing 20A. FIG. 1F illustrates a side, cut away view of top housing portion 20A with contact portion 42 embedded or molded into housing 20A.

In the above embodiment, concave portion 56 is submounted (recessed) into the housing so as to aid retention as well as create, when assembled, a larger contact area for the ball to fall into. The degree of tilt needed to actuate the switch can be adjusted by increasing or decreasing the diameter of the free moving metallic ball. Due to the nature of the assembled geometry, the switch can actuate in any direction or combination of angles. The polymer housing of the switch can also incorporate assembly aids to assist in final placement onto a circuit board.

Referring to FIGS. 2A–2F, a tilt sensor 110 is illustrated that includes an insulative (e.g. polymer) sensor housing 120 that is comprised of two housing members, a top housing member 120*a*, and a bottom housing member 120*b* that are configured to fit together to form a single sensor housing 120. Sensor 110 further includes a top housing aperture 122*a* and a top housing pin 124*a* that correspond to a bottom housing aperture 122*b* and a bottom housing pin 124*b* that fit together to align the housings (and conductive members 140 and 150) with each other. The fitted housings together also form a cavity 130 within housing 120. Top housing member 120*a* includes an insert molded, top conductive member 140 that is comprised of a contact portion 142 and a lead portion 144.

Bottom housing member 120*b* includes an insert molded bottom conductive member 150 that includes a contact portion 152 and a lead portion 154 that partially protrudes outside of housing 120. Inside of cavity 130 and bounded by conductive members 140 and 150 is a conductive spherical member 160 (e.g. metallic ball) that rolls within cavity 130 of sensor 110 as the sensor is tipped. Contact portion 152 includes a concave portion 156 (in the form of a spoon or ladle) that can easily capture ball 160.

In one example, switch 110 is comprised of 2 distinct concave inductive (metallic) members 140, 150) that are insert molded into each polymer housing half. Both inserts are sub-mounted (recessed) so as to aid retention as well as create, when assembled, a larger contact area for spherical member 160 (or ball) to fall into. Top housing member 120*a* differs from the lower by using a continuous radial saddle (.200 R.) polymer crown which, upon inversion, forces the ball into the contact position. The free-floating metallic ball is dropped into one half prior to assembly. The degree of tilt sensitivity can be adjusted by increasing or decreasing the diameter of the metallic ball, varying the size of the gap between the contacts or varying the shape or radius of the contact portions. Due to the nature of the assembled geometry, the tilt switch can actuate in any direction or combination of angles in any direction. The polymer housing members can also incorporate assembly aids to assist in final placement onto a circuit board. Polymer plating in the housing members could also be used as a substitute for the metallic (inserts) conductive members.

Figures 2A, 2B, 2C, 2E:
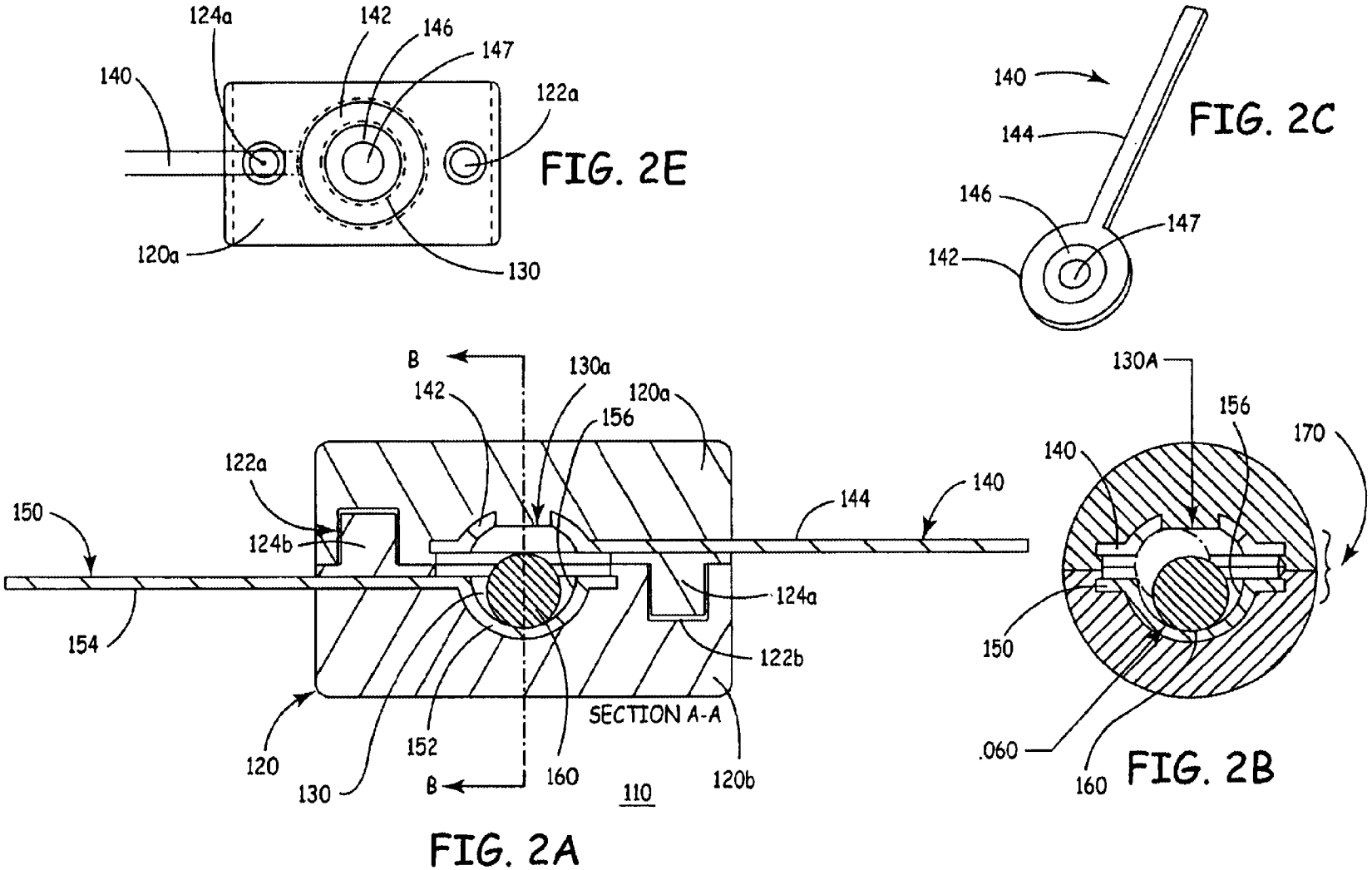
FIG. 2A is a cut away side view of another embodiment of a tilt sensor according to the present invention.
FIG. 2B is a cut away view of the tilt sensor of FIG. 2A along section B—B.
FIG. 2C is another embodiment of a conductive member used in a tilt sensor of the present invention.
FIG. 2E illustrates a top view of the bottom half of the tilt sensor housing with a conductive member.

FIG. 2B illustrates a cut away, side view of sensor 110 along section B—B of FIG. 2A. In this example embodiment, spherical member (or ball) 160 rests on bottom conductive member 150. A gap 170 between top conductive member 140 and bottom conductive member 150 (members 140 and 150 are spaced apart) is formed so as to have a degree of electrical isolation or separation between the two conductive members. When tilt sensor 110 is tipped (or angle of inclination is imparted) conductive spherical member 160 moves towards gap 170 and eventually spherical member 160 electrically connects top conductive member 140 and bottom conductive member 150 to close an electrical circuit (see shadow of ball 160). In this example embodiment, closing the electrical circuit constitutes a signal that tilt sensor 110 has been tipped to such an angle of inclination so as to close the circuit. In one example embodiment, tilt sensor 110 is used in connection with a watt-hour meter as a means for signaling and detecting tampering with the meter, such as when the meter is removed from its socket, is tilted or is turned upside down to interfere with its normal operation.

FIG. 2C illustrates one example embodiment of a top contact member 140 which is configured in the form of a hollowed-out spoon having a concave portion 146, an aperture 147, and a lead portion 144 that partially extends outside of housing 120. As will be discussed later, contact portion 142 and housing 120*a* are configured to reject metallic ball 160 in the sensor inverted position.

Figure 2F:
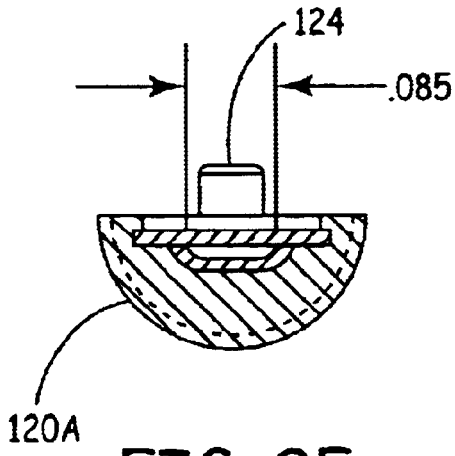
FIG. 2F illustrates an end, cut away view of FIG. 2E of the bottom half of the sensor housing.
Figure 2D:
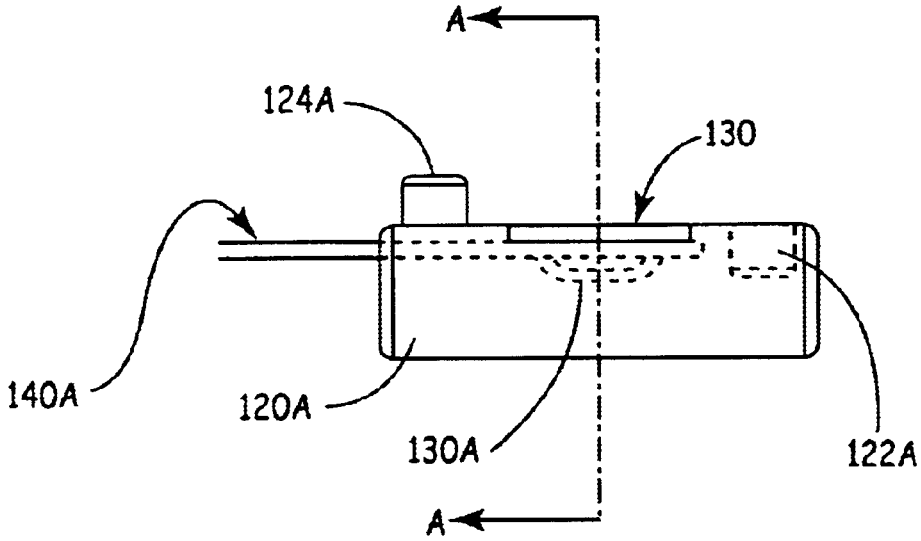
FIG. 2D illustrates a side view of the top half of the housing of the tilt sensor of the present invention.

FIGS. 2D–2F illustrate partial views of sensor 110. In particular, FIG. 2D illustrates a side view of the top half of sensor 110 with top conductive member 140 embedded in housing 120*a*. FIG. 2E illustrates a top view of top housing member 120*a* with pin 124*a* protruding from the housing and an aperture 122*a* formed in housing 120*a*. FIG. 2F illustrates an end, cut away view of top housing portion 120*a* with contact portion 142 embedded or molded into housing 120*a*. Top half 120*a* is illustrated as including aperture 122*a* and pin 124*a* with a portion of cavity 130 shown in invisible lines formed in top housing member 120*a*. Note that the bottom of cavity 130 is in a convex configuration 130*a* in order to prevent the spherical member from resting on cavity 130, thereby forcing it to move back towards gap 170 or to its steady state position on the bottom of housing 120*b*. In this example, conductive member 140 includes an aperture 147. However, conductive member 140 can also be configured to have a convex portion instead of aperture 147 so that the housing need not be convex and pushes spherical member 160 back to the bottom of housing 120*b* and contact portion 152.

In the various embodiments disclosed the conductive members are illustrated as having a spoon-like configuration. However, the invention is not necessarily limited to this configuration in the conductive member since the conductive member can be configured in the form of a square, a rectangle, or a pyramid/cone for holding or cupping spherical member 60. The conductive members are adapted to be configured into different shapes for facilitating mounting on a printed circuit board or another apparatus. In a related embodiment, the conductive members are functionally substitutable with a polymer plating on both housings and cavity. The plated conductive members extend beyond the inside of the polymer housing and are formed as tracks on the outside of the polymer housing to facilitate electrical contact with other electrical components. Although the primary advantage of the present invention (for environmental purposes) would be to use a metallic ball, a glob of mercury could also be utilized where the housing is hermetically sealed and the tilt switch application requires a more stable contact between the conductive members (e.g., conductive members 40 and 50). It has been discovered that the present invention is less susceptible to false tamper signals (that may be caused by vibration or inadvertent jarring of the sensor) because the metallic spherical member is less likely to fall into the gap (e.g., gaps 70 or 170) and contact both conductive members simultaneously.

Various modifications, equivalent processes, as well as numerous structures to which the present invention may be applicable will be readily apparent to those of skill in the art to which the present invention is directed upon review of the present specification. The claims are intended to cover such modifications and devices.

What is claimed is:

1. A tilt sensor comprising:

a first insulative housing member having therein a first electrical conductive member having a first contact portion and a first lead portion extending through and outwardly from the first insulative housing member;

a second insulative housing member having therein a second electrically conductive member having a second contact portion and a second lead portion extending through and outwardly from the second insulative housing member, the second insulative housing member formed to interlockingly join with the first insulative housing member to form a tilt sensor housing, the tilt sensor housing having a cavity defined therein by the first and second conductive members;

a pin and a mating aperture, integrally formed into the first and second insulative housing members;

a conductive spherical member disposed within the cavity, wherein the first and second contact portions are spaced apart within the housing cavity so as to form a gap, the gap being electrically closed with the conductive spherical member when the tilt sensor is within a predefined range of angles of inclination; and wherein the first insulative housing member and the second insulative housing member are similarly shaped and the first lead portion and the second lead portion extend from opposed ends of the tilt sensor when the first insulative housing member and the second insulative housing member are interlockingly joined.

2. The tilt sensor of claim 1, wherein the first contact portion is substantially concave in configuration.

3. The tilt sensor of claim 2, wherein the second contact portion is substantially concave in configuration.

4. The tilt sensor of claim 2, wherein the second contact portion is configured to include an outer concave portion and an inner exposed portion that exposes a portion of the second insulative housing member.

5. The tilt sensor of claim 4, wherein the exposed portion of the second insulative housing member is a convex configuration.

6. The tilt sensor of claim 2, wherein the second contact portion is configured to include an outer concave portion and a convex inner portion.

7. The tilt sensor of claim 1, wherein the first contact portion has a configuration that is selected from the group consisting of a cone, a square, a spoon, and a rectangle.

8. The tilt sensor of claim 1, wherein the conductive member is selected from the group consisting of a metallic ball, a metallic coated spherical member, and a droplet of mercury.

9. The tilt sensor of claim 8, wherein the sensitivity of the sensor is a function of a diameter of the conductive spherical member.

10. The tilt sensor of claim 1, wherein the second contact portion has a configuration that is selected from the group consisting of a cone, a square, a spoon and a rectangle.

11. The tilt sensor of claim 1, wherein the housing members are held together via a sonic weld, an adhesive, a clip, a band or a metal canister.

12. A tilt sensor comprising:

a first insulative housing member having therein a first electrical conductive member having a first contact portion and a first lead portion extending through and outwardly from the first insulative housing member;

a second insulative housing member having therein a second electrically conductive member having a second contact portion and a second lead portion extending through and outwardly from the second insulative housing member, the second insulative housing member shaped to interlockingly join with the first insulative housing to form a tilt sensor housing, the tilt sensor housing having a cavity defined therein by the first and second conductive members, wherein a second portion of the cavity adjacent the second insulative housing is smaller than a first portion of the cavity adjacent the first insulative housing;

means, integral with the first and second insulative housing members, for aligning the first and second contact portions to each other; and a conductive spherical member disposed within the cavity, wherein the first and second contact portions are spaced apart within the housing cavity so as to form a gap, the gap being electrically closed with the conductive spherical member when the tilt sensor exceeds a certain angle of inclination and wherein the smaller second cavity portion facilitates inversion detection by the tilt sensor as the conductive spherical member is maintained in the gap after the sensor exceeds the certain angle of inclination.

13. The tilt sensor of claim 12, wherein the second portion of the cavity is configured from an outer concave portion of the second conductive member and an inner exposed portion of the second conductive member that exposes a portion of the second insulative housing member.

14. The tilt sensor of claim 13, wherein the exposed portion of the second insulative housing member is a convex configuration.

15. The tilt sensor of claim 12, wherein the second contact portion of the cavity is configured from an outer concave portion of the second conductive member and a convex inner portion of the second conductive member.

16. A tilt sensor comprising:

a first insulative housing member having thereon a first electrical conductive coating comprised of a first contact portion and a first lead portion extending through and along an outer surface of the first insulative housing member;

a second insulative housing member having thereon a second electrically conductive coating comprised of a second contact portion and a second lead portion extending through and along the outer surface of the second insulative housing member, the second insulative housing shaped to interlockingly join with the first insulative housing to form a tilt sensor housing, the tilt sensor housing having a cavity bounded by the first and second contact portions;

a pin and a mating aperture, integrally formed into the first and second insulative housing members;

a conductive spherical member disposed within the cavity, wherein the first and second contact portions are spaced apart within the housing cavity so as to form a gap, the gap being electrically closed with the conductive spherical member when the tilt sensor is within a predefined range of angles of inclination; and wherein the first insulative housing member and the second insulative housing member are similarly shaped and a first lead portion and a second lead portion extend from opposed ends of the tilt sensor when the first insulative housing member and the second insulative housing member are interlockingly joined.

17. The tilt sensor of claim 16, wherein a second portion of the cavity adjacent the second insulative housing is smaller than a first portion of the cavity adjacent the first insulative housing.

18. The tilt sensor of claim 16, wherein the sensitivity of the sensor is a function of a diameter of the spherical member, the size of the gap and a shape of the contact portions of the conductive coatings.

19. A tilt sensor comprising:

a first insulative housing member having therein a first electrical conductive member having a first contact portion and a first lead portion extending through and outwardly from the first insulative housing member;

a second insulative housing member having therein a second electrically conductive member having a second contact portion and a second lead portion extending through and outwardly from the second insulative housing member, the second insulative housing member being shaped to interlockingly join with the first insulative housing member to form a tilt sensor housing, the tilt sensor housing having a cavity defined therein by the first and second conductive members and wherein the second contact portion is configured to include an outer concave portion and a convex inner portion;

means, integral with the first and second insulative housing members, for aligning the first and second contact portions to each other; and a conductive spherical member disposed within the cavity, wherein the first and second contact portions are spaced apart within the housing cavity so as to form a gap, the gap being electrically closed with the conductive spherical member when the tilt sensor is within a predefined range of angles of inclination.

20. The tilt sensor of claim 19, wherein the second contact portion is configured to include an outer concave portion and an inner exposed portion that exposes a portion of the second insulative housing member.

21. The tilt sensor of claim 20, wherein the exposed portion of the second insulative housing member is a convex configuration.

22. The tilt sensor of claim 19, wherein the means for aligning the first and second contact portions includes a metal tube.

23. A tilt sensor comprising:

a first insulative housing member having therein a first electrical conductive member having a first contact portion and a first lead portion extending through and outwardly from the first insulative housing member;

a second insulative housing member having therein a second electrically conductive member having a second contact portion and a second lead portion extending through and outwardly from the second insulative housing member, the second insulative housing member shaped to interlockingly join with the first insulative housing to form a tilt sensor housing, the tilt sensor housing having a cavity defined therein by the first and second conductive members, wherein a second portion of the cavity adjacent the second insulative housing is smaller than a first portion of the cavity adjacent the first insulative housing;

means, integral with the first and second insulative housing members, for aligning the first and second contact portions to each other;

a conductive spherical member disposed within the cavity, wherein the first and second contact portions are spaced apart within the housing cavity so as to form a gap, the gap being electrically closed with the conductive spherical member when the tilt sensor exceeds a certain angle of inclination and wherein the smaller second cavity portion facilitates inversion detection by the tilt sensor as the conductive spherical member is maintained in the gap after the sensor exceeds the certain angle of inclination; and wherein the second portion of the cavity is configured from an outer concave portion of the second conductive member and an inner exposed portion of the second conductive member that exposes a portion of the second insulative housing member.

24. The tilt sensor of claim 23, wherein the exposed portion of the second insulative housing member is a convex configuration.

25. A tilt sensor comprising:

a first insulative housing member having therein a first electrical conductive member having a first contact portion and a first lead portion extending through and outwardly from the first insulative housing member;

a second insulative housing member having therein a second electrically conductive member having a second contact portion and a second lead portion extending through and outwardly from the second insulative housing member, the second insulative housing member shaped to interlockingly join with the first insulative housing to form a tilt sensor housing, the tilt sensor housing having a cavity defined therein by the first and second conductive members, wherein a second portion of the cavity adjacent the second insulative housing is smaller than a first portion of the cavity adjacent the first insulative housing;

means, integral with the first and second insulative housing members, for aligning the first and second contact portions to each other;

a conductive spherical member disposed within the cavity, wherein the first and second contact portions are spaced apart within the housing cavity so as to form a gap, the gap being electrically closed with the conductive spherical member when the tilt sensor exceeds a certain angle of inclination and wherein the smaller second cavity portion facilitates inversion detection by the tilt sensor as the conductive spherical member is maintained in the gap after the sensor exceeds the certain angle of inclination; and wherein the second contact portion of the cavity is configured from an outer concave portion of the second conductive member and a convex inner portion of the second conductive member.

* * * * *

UNITED STATES PATENT AND TRADEMARK OFFICE

CERTIFICATE OF CORRECTION

PATENT NO. : 6,852,935 B2 
DATED : February 8, 2005
INVENTOR(S) : Sidney A. Higgens and Timothy M. Moutka It is certified that error appears in the above-identified patent and that said Letters Patent is hereby corrected as shown below:

Column 2,
Line 6, delete "hall" and insert -- ball --.

Column 8,
Line 59, delete "the".

Signed and Sealed this

Twenty-eighth Day of June, 2005

JON W. DUDAS
*Director of the United States Patent and Trademark Office*